US006362151B1

(12) United States Patent
Wichmann et al.

(10) Patent No.: US 6,362,151 B1
(45) Date of Patent: Mar. 26, 2002

(54) GRANULAR DETERGENT COMPOSITION CONTAINING SECONDARY (2,3) ALKYL SULFATE SURFACTANT AND A BLEACH/BLEACH ACTIVATOR SYSTEM

(75) Inventors: Todd Edmund Wichmann; Edward Eugene Getty, both of Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 08/972,703

(22) Filed: Nov. 18, 1997

Related U.S. Application Data

(63) Continuation of application No. 08/561,222, filed on Nov. 21, 1995, which is a continuation of application No. 08/108, 208, filed on Aug. 17, 1993.

(51) Int. Cl.[7] ..... C11D 7/18; C11D 7/54

(52) U.S. Cl. ..... 510/372; 510/373; 510/374; 510/375; 510/379

(58) Field of Search ..... 510/372, 373, 510/374, 375, 379

(56) References Cited

U.S. PATENT DOCUMENTS

| | | | | |
|---|---|---|---|---|
| 4,226,797 A | * | 10/1980 | Bakker | 260/460 |
| 4,486,327 A | | 12/1984 | Murphy et al. | 252/94 |
| 4,536,314 A | | 8/1985 | Hardy et al. | 252/102 |
| 4,681,592 A | | 7/1987 | Hardy et al. | 8/111 |
| 4,861,502 A | * | 8/1989 | Caswell | 252/8.75 |
| 5,281,366 A | * | 1/1994 | Lutz | 252/550 |

OTHER PUBLICATIONS

U.S. application No. 07/965,478, DiGiulio et al., filed Oct. 23, 1992, entitled Granular Detergents with Protease Enzyme and Bleach, abandoned.

U.S. application No. 08/045,402, Murch et al., filed Apr. 8, 1993, entitled Secondary (2,3) alkyl Sulfate Surfactants in Stable Liquid or Gel and Other Calcium–containing Detergent Compositions.

U.S. application No. 08/045,744, Murch et al., filed Apr. 8, 1993, entitled Secondary (2,3) Alkyl Sulfate Surfactants in Stable Enzyme–containing Detergent Compositions.

U.S. application No. 08/045,401, Morrall et al., filed Apr. 8, 1993, entitled Secondary (2,3) Alkyl Sulfate Surfactants in Stable Liquid or Gel and Other Magnesium–containing Detergent Compositions.

U.S. application No. 08/045,745, Welch et al., filed Apr. 8, 1993, entitled Secondary (2,3) Alkyl Sulfate Surfactants in High Density Granular Detergent Compositions.

U.S. application No. 08/045,501, Vinson, filed Apr. 8, 1993, entitled Secondary(2,3) Alkyl Sulfate Surfactants to Coat Free–flowing Granular Detergent Compositions.

U.S. application No. 08/045,746, Morrall et al., filed Apr. 8, 1993, entitled Secondary (2,3) Alkyl Sulfate Surfactants in Mixed Surfactant Particles.

U.S. application No. 08/045,406, Murch, filed Apr. 8, 1993, entitled Purification of Secondary (2,3) Alkyl Sulfate Surfactants.

* cited by examiner

*Primary Examiner*—Robert Gerstl
(74) *Attorney, Agent, or Firm*—Marianne Dressman; Kim William Zerby; Steven W. Miller

(57) ABSTRACT

A granular detergent composition containing a secondary (2,3) alkyl sulfate surfactant and a bleach/bleach activator system which has improved cleaning performance is provided. The detergent composition comprises: (a) from about 1% to about 40% of a secondary (2,3) alkyl sulfate surfactant; (b) from about 0.005% to about 5% of an enzyme; (c) from about 0.5% to about 20% of a peroxygen bleaching agent; and (d) from about 0.5% to about 20% of a bleach activator. The peroxygen bleaching compound and the bleach activator are in a molar ratio from about 1:1 to about 9:1. The detergent composition is stable, exhibits superior cleaning and contains a more biodegradable surfactant.

8 Claims, No Drawings

GRANULAR DETERGENT COMPOSITION CONTAINING SECONDARY (2,3) ALKYL SULFATE SURFACTANT AND A BLEACH/BLEACH ACTIVATOR SYSTEM

This is a continuation of application Ser. No. 08/561,222, filed on Nov. 21, 1995 which is a continuation of application Ser. No. 08/108,208, filed on Aug. 17, 1993.

FIELD OF THE INVENTION

The present invention relates to a granular detergent composition and more particularly, to a granular detergent composition containing secondary (2,3) alkyl surfactant, a bleaching agent and a bleach activator together which are combined within an optimum molar ratio range. The granular detergent composition as described herein surprisingly exhibits improved cleaning performance, especially with respect to greasy and oily stains.

BACKGROUND OF THE INVENTION

Typically, conventional detergent compositions contain mixtures of various surfactants in order to remove a wide variety of soils and stains from surfaces. For example, various anionic surfactants, especially the alkyl benzene sulfonates, are useful for removing particulate soils, and various nonionic surfactants, such as the alkyl ethoxylates and alkylphenol ethoxylates, are useful for removing greasy soils.

While the art is replete with a wide variety of surfactants for those skilled in the art of detergent formulation, most of the available surfactants are specialty chemicals which are not suitable for routine use in low cost items such as home laundering compositions. The fact remains that many home-use laundry detergents still comprise one or more of the conventional alkyl benzene sulfonates or primary alkyl sulfate surfactants. One class of surfactants which has found limited use in various compositions where emulsification is desired comprises the secondary alkyl sulfates. The conventional secondary alkyl sulfate surfactants are available as generally pasty, random mixtures of sulfated linear and/or partially branched alkanes.

For example, Rossall et al, U.S. Pat. No. 4,235,752, disclose a detergent surfactant which is a $C_{10-18}$ secondary alkyl sulfate containing 50% of ⅔ sulfate isomers and 40% of various other effective isomers. The surfactant materials disclosed by Rossall et al is for use primarily in dishwashing operations. Such materials have not come into widespread use in laundry detergents, since they do not offer any advantages over alkyl benzene sulfonates, especially with respect to water solubility which facilitates production of high-surfactant granular detergents and with respect to biodegradability. It would therefore be desirable to have a granular detergent composition containing a surfactant which has improved water solubility and biodegradability.

As is well known, even when those skilled in the art have selected an appropriate surfactant for a granular detergent composition, the compatibility of the surfactant with the other detergent ingredients must be addressed. For example, enzymes typically used in detergent compositions are notorious for their instability problems, especially when used in conjunction with detergent surfactants which tend to denature, degrade and deactivate the enzymes. While this is the case for amylases, cellulases and peroxidases, it is particularly true for lipases and proteases.

Such problems are especially exacerbated in the presence of a bleach and/or bleach/bleach activator system, both of which are known to oxidize enzymes. By way of example, Hardy et al, U.S. Pat. No. 4,536,314 (commonly assigned), disclose a granular detergent composition containing a bleaching compound, a bleach activator, an enzyme and surfactant, inter alia. By choosing appropriate ingredients and corresponding levels, Hardy et al produce a stable granular detergent composition. However, while Hardy et al disclose a granular detergent composition which is apparently effective, they only incorporate surfactants such as alkyl benzene sulfonates which do not have the solubility and biodegradability advantages to which were referred above.

Accordingly, despite the disclosures discussed above, there is a need in the art for a granular detergent composition containing a surfactant having improved water solubility and biodegradability. There is also a need in the art for such a granular detergent which has improved cleaning performance, especially with respect to greasy and oily stains.

SUMMARY OF THE INVENTION

The present invention meets the needs in the art identified above by providing a granular detergent composition which contains a surfactant which has improved solubility and biodegradability in combination with an enzyme and bleaching system. Moreover, the granular detergent composition also surprisingly exhibits superior cleaning performance, especially with respect to greasy and oily stains. The granular detergent composition contains a biodegradable surfactant, an enzyme and a bleaching system, together which are extremely stable in granular form. The bleaching system comprises a bleaching agent and a bleach activator which are present within an optimum molar ratio range. All percentages used herein are expressed as "percent-by-weight" unless otherwise indicated.

In accordance with one aspect of the invention, a granular detergent is provided. The granular detergent composition comprises: (a) from about 1% to about 40% of a secondary (2,3) alkyl sulfate surfactant; (b) from about 0.005% to about 5% of an enzyme; (c) from about 0.5% to about 20% of a peroxygen bleaching agent; and (d) from about 0.5% to about 20% of a bleach activator having the formula

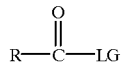

wherein R is an alkyl group containing from about 5 to about 18 carbon atoms and LG is a leaving group, the conjugate acid of which has a $pK_a$ of from about 4 to about 13. The peroxygen bleaching compound and the bleach activator are in a molar ratio from about 1:1 to about 9:1.

In a preferred embodiment, the bleach activator has the formula

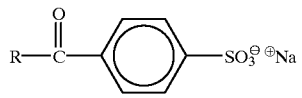

wherein R is an alkyl chain containing from about 1 to about 11 carbon atoms. A method of laundering soiled clothes is also provided. The method comprises the step of contacting the soiled clothes with an effective amount (typically at least about 0.01%/e, preferably at least about 0.05% by weight in the washing solution) of a granular detergent composition according to the invention in an aqueous media.

Accordingly, it is an object of the present invention to provide a granular detergent composition containing a surfactant having improved solubility and biodegradability. It is also an object of the invention to provide such a granular detergent which has improved cleaning performance and stability. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENT

In the broadest aspect, the granular detergent composition of the invention comprises a secondary (2,3) alkyl sulfate surfactant, an enzyme, a peroxygen bleaching agent, and a bleach activator wherein the peroxygen bleaching compound and the bleach activator are in a molar ratio from about 1:1 to about 9:1. Other preferred variants of the granular detergent composition are described hereinafter.

Secondary (2,3) Alkyl Sulfate Surfactant

The granular detergent composition preferably contains from about 1% to about 400/%, more preferably from about 2.6% to about 20%, and most preferably from about 3.3% to about 16% of a secondary (2,3) alkyl sulfate surfactant as described herein. For the convenience of those skilled in the art the following discussion of the secondary (2,3) alkyl sulfates used herein will be distinguished from conventional alkyl sulfate surfactants where appropriate.

Conventional primary alkyl sulfate surfactants have the general formula $$ROSO_3^-M^+$$

wherein R is typically a linear $C_{10}$–$C_{20}$ hydrocarbyl group and M is a water-solubilizing cation. Branched-chain primary alkyl sulfate surfactants (i.e., branched-chain "PAS") having 10–20 carbon atoms are also known; see, for example, European Patent Application 439,316, Smith et al, filed Jan. 21, 1991, the disclosure of which is incorporated herein by reference.

Conventional secondary alkyl sulfate surfactants are those materials which have the sulfate moiety distributed randomly along the hydrocarbyl "backbone" of the molecule. Such materials may be depicted by the structure $$CH_3(CH_2)_n(CHOSO_3^-M^+)(CH_2)_mCH_3$$

wherein m and n are integers of 2 or greater and the sum of m+n is typically about 9 to 17, and M is a water-solubilizing cation.

By contrast with the above, the selected secondary (2,3) alkyl sulfate surfactants used herein comprise structures of formulas A and B $$CH_3(CH_2)_x(CHOSO_3^-M^+)\ CH_3 \text{ and} \quad (A)$$

$$CH_3(CH_2)_y(CHOSO_3^-M^+)CH_2CH_3 \quad (B)$$

for the 2-sulfate and 3-sulfate, respectively. Mixtures of the 2- and 3-sulfate can be used herein. In formulas A and B, x and (y+1) are, respectively, integers of at least about 6, and can range from about 7 to about 20, preferably about 10 to about 16. M is a cation, such as an alkali metal, ammonium, alkanolammonium, alkaline earth metal, or the like. Sodium is typical for use as M to prepare the water-soluble (2,3) alkyl sulfates, but ethanolammonium, diethanolammonium, triethanolammonium, potassium, ammonium, and the like, can also be used.

By the present invention, it has been determined that the physical/chemical properties of the foregoing types of alkyl sulfate surfactants are unexpectedly different, one from another, in several aspects which are important to formulators of various types of detergent compositions, for example, the primary alkyl sulfates can disadvantageously interact with, and even be precipitated by, metal cations such as calcium and magnesium. Thus, water hardness can negatively affect the primary alkyl sulfates to a greater extent than the secondary (2,3) alkyl sulfates herein. Accordingly, the secondary (2,3) alkyl sulfates have now been found to be preferred for use in the presence of calcium ions and under conditions of high water hardness, or in the so-called "under-built" situation which can occur when nonphosphate builders are employed.

Moreover, the solubility of the primary alkyl sulfates is not as great as the secondary (2,3) alkyl sulfates. Hence, the formulation of high-active surfactant particles has now been found to be simpler and more effective with the secondary (2,3) alkyl sulfates than with the primary alkyl sulfates. Thus, in addition to compatibility with enzymes, the secondary (2,3) alkyl sulfates are exceptionally easy to formulate as heavy-duty granular laundry detergents.

With regard to the random secondary alkyl sulfates (i.e., secondary alkyl sulfates with the sulfate group at positions such as the 4, 5, 6, 7, etc. secondary carbon atoms), such materials tend to be tacky solids or, more generally, pastes. Thus, the random alkyl sulfates do not afford the processing advantages associated with the solid secondary (2,3) alkyl sulfates when formulating detergent granules. Moreover, the secondary (2,3) alkyl sulfates herein provide better sudsing than the random mixtures. It is preferred that the secondary (2,3) alkyl sulfates be substantially free (i.e., contain less than about 20%, more preferably less than about 10%, most preferably less than about 5%) of such random secondary alkyl sulfates.

One additional advantage of the secondary (2,3) alkyl sulfate surfactants herein over other positional or "random" alkyl sulfate isomers is in regard to the improved benefits afforded by said secondary (2,3) alkyl sulfates with respect to soil redeposition in the context of fabric laundering operations. As is well-known to users, laundry detergents loosen soils from fabrics being washed and suspend the soils in the aqueous laundry liquor. However, as is well-known to detergent formulators, some portion of the suspended soil can be redeposited back onto the fabrics. Thus, some redistribution and redeposition of the soil onto all fabrics in the load being washed can occur. This, of course, in undesirable and can lead to the phenomenon known as fabric "greying". (As a simple test of the redeposition characteristics of any given laundry detergent formulation, unsoiled white "tracer" cloths can be included with the soiled fabrics being laundered. At the end of the laundering operation the extent to which the white tracers deviate from their initial degree of whiteness can be measured photometrically or estimated visually by skilled observers. The more the tracers' whiteness is retained, the less soil redeposition has occurred.)

It has now been determined that the secondary (2,3) alkyl sulfates afford substantial advantages in soil redeposition characteristics over the other positional isomers of secondary alkyl sulfates in laundry detergents, as measured by the cloth tracer method noted above. Thus, the selection of secondary (2,3) alkyl sulfate surfactants according to the practice of this invention which preferably are substantially free of other positional secondary isomers unexpectedly assists in solving the problem of soil redeposition in a manner not heretofore recognized.

It is to be noted that the secondary (2,3) alkyl sulfates used herein are quite different in several important properties from the secondary olefin sulfonates (e.g., U.S. Pat. No. 4,064,076, Klisch et al, Dec. 12, 1977; accordingly, the secondary sulfonates are not the focus of the present invention.

The preparation of the secondary (2,3) alkyl sulfates of the type useful herein can be carried out by the addition of $H_2SO_4$ to olefins. A typical synthesis using α-olefins and sulfuric acid is disclosed in U.S. Pat. No. 3,234,258, Morris, or in U.S. Pat. No. 5,075,041, Lutz, granted Dec. 24, 1991, both of which are incorporated herein by reference. The synthesis, conducted in solvents which afford the secondary (2,3) alkyl sulfates on cooling, yields products which, when purified to remove the unreacted materials, randomly sulfated materials, unsulfated by-products such as $C_{10}$ and higher alcohols, secondary olefin sulfonates, and the like, are typically 90+% pure mixtures of 2- and 3-sulfated materials (up to 10% sodium sulfate is typically present) and are white, non-tacky, apparently crystalline, solids. Some 2,3-disulfates may also be present, but generally comprise no more than 5% of the mixture of secondary (2,3) alkyl mono-sulfates. Such materials are available as under the name "DAN", e.g., "DAN 200" from Shell Oil Company.

If increased solubility of the "crystalline" secondary (2,3) alkyl sulfate surfactants is desired, the formulator may wish to employ mixtures of such surfactants having a mixture of alkyl chain lengths. Thus, a mixture of $C_{12}$–$C_{18}$ alkyl chains will provide an increase in solubility over a secondary (2,3) alkyl sulfate wherein the alkyl chain is, say, entirely $C_{16}$. The solubility of the secondary (2,3) alkyl sulfates can also be enhanced by the addition thereto of other surfactants such as the material which decreases the crystallinity of the secondary (2,3) alkyl sulfates. Such crystallinity-interrupting materials are typically effective at levels of 20%, or less, of the secondary (2,3) alkyl state.

When formulating liquid compositions, especially clear liquids, it is preferred that the secondary (2,3) alkyl sulfate surfactants contain less than about 3% sodium sulfate, preferably less than about 1% sodium sulfate. In and of itself, sodium sulfate is an innocuous material. However, it dissolves and adds to the ionic "load" in aqueous media, and this can contribute to phase separation in the liquid compositions and to gel breaking in the gel compositions.

Various means can be used to lower the sodium sulfate content of the secondary (2,3) alkyl sulfates. For example, when the $H_2SO_4$ addition to the olefin is completed, care can be taken to remove unreacted $H_2SO_4$ before the acid form of the secondary (2,3) alkyl sulfate is neutralized. In another method, the sodium salt form of the secondary (2,3) alkyl sulfate which contains sodium sulfate can be rinsed with water at a temperature near or below the Krafft temperature of the sodium secondary (2,3) alkyl sulfate. This will remove $Na_2SO_4$ with only minimal loss of the desired, purified sodium secondary (2,3) alkyl sulfate. Of course, both procedures can be used, the first as a pre-neutralization step and the second as a post-neutralization step.

The term "Krafft temperature" as used herein is a term of art which is well-known to workers in the field of surfactant sciences. Krafft temperature is described by K. Shinoda in the text "Principles of Solution and Solubility", translation in collaboration with Paul Becher, published by Marcel Dekker, Inc. 1978 at pages 160–161, the disclosure of which is incorporated herein by reference. Stated succinctly, the solubility of a surface active agent in water increases rather slowly with temperature up to that point, i.e., the Krafft temperature, at which the solubility evidences an extremely rapid rise. At a temperature approximately 4° C. above the Krafft temperature a solution of almost any composition becomes a homogeneous phase. In general, the Krafft temperature of any given type of surfactant, such as the secondary (2,3) alkyl sulfates herein which comprise an anionic hydrophilic sulfate group and a hydrophobic hydrocarbyl group, will vary with the chain length of the hydrocarbyl group. This is due to the change in water solubility with the variation in the hydrophobic portion of the surfactant molecule.

In the practice of the present invention, the formulator may optionally wash the secondary (2,3) alkyl sulfate surfactant which is contaminated with sodium sulfate with water at a temperature that is no higher than the Krafft temperature, and which is preferably lower than the Krafft temperature, for the particular secondary (2,3) alkyl sulfate being washed. This allows the sodium sulfate to be dissolved and removed with the wash water, while keeping losses of the secondary (2,3) alkyl sulfate into the wash water to a minimum.

Under circumstances where the secondary (2,3) alkyl sulfate surfactant herein comprises a mixture of alkyl chain lengths, it will be appreciated that the Krafft temperature will not be a single point but, rather, will be denoted as a "Krafft boundary". Such matters are well-known to those skilled in the science of surfactant/solution measurements. In any event, for such mixtures of secondary (2,3) alkyl sulfates, it is preferred to conduct the optional sodium sulfate removal operation at a temperature which is below the Krafft boundary, and preferably below the Krafft temperature of the shortest chain-length surfactant present in such mixtures, since this avoids excessive losses of secondary (2,3) alkyl sulfate to the wash solution. For example, for $C_{16}$ secondary sodium alkyl (2,3) sulfate surfactants, it is preferred to conduct the washing operation at temperatures below about 30° C., preferably below about 20° C. It will be appreciated that changes in the cations will change the preferred temperatures for washing the secondary (2,3) alkyl sulfates, due to changes in the Krafft temperature.

The washing process can be conducted batchwise by suspending wet or dry secondary (2,3) alkyl sulfates in sufficient water to provide 10–50% solids, typically for a mixing time of at least 10 minutes at about 22° C. (for a $C_{16}$ secondary (2,3) alkyl sulfate), followed by pressure filtration. In a preferred mode, the slurry will comprise somewhat less than 35% solids, inasmuch as such slurries are free-flowing and amenable to agitation during the washing process. As an additional benefit, the washing process also reduces the levels of organic contaminants which comprise the random secondary alkyl sulfates noted above.

Bleaching System

The granular detergent composition of the invention also includes a bleaching system comprising a peroxygen bleaching agent and a bleach activator. With regard to the relative proportions, the detergent composition preferably comprises from about 0.5% to about 20%, more preferably from about 1.4% to about 11.6% and, most preferably from about 2.5% to about 6.2% of the peroxygen bleaching agent. Also, the detergent composition comprises from about 0.5% to about 20%, more preferably from about 2.0% to about 6.0% and most preferably from about 4.0% to about 4.6% of the bleach activator. Importantly, the bleaching system used herein preferably contains the bleaching agent and bleach activator in a molar ratio from about 1:1 to about 9:1, and most preferably from about 1.75:1 to about 4.5:1.

The peroxygen bleaching agents can be any of those peroxygen bleaching agents useful for detergent compositions in textile cleaning that are known or become known. Preferably, the bleaching agent is selected from the group consisting of percarbonates, perborates, peroxides and mixtures thereof. While intending not to be limiting, included within this group are sodium carbonate peroxyhydrate and equivalent "percarbonate" bleaches, sodium pyrophosphate peroxyhydrate, urea peroxyhydrate, sodium perborate (e.g. mono- or tetra-hydrate) and sodium peroxide. It should be understood that other peroxygen bleaches other than those described herein may be used in the detergent composition without departing from the scope of the invention.

Preferably, the peroxygen bleaching agent used herein is combined with a bleach activator which leads to the in situ production in aqueous solution (i.e. during the laundering process) of the peroxy acid corresponding to the activator. The bleaching mechanism generally, and the surface bleaching mechanism in particular, in the washing solution are not completely understood. While not intending to be limited by theory, however, it is believed that the bleach activator undergoes nucleophilic attack by a perhydroxide anion, for example from aqueous hydrogen peroxide, to form a percarboxylic acid. This reaction is commonly referenced in the art as perhydrolysis.

A second species present in the washing solution is the diacylperoxide (also referred to herein as "DAP"). It is imperative that some DAP production is present in order to improve bleaching of specific stains such as, for example, those stains caused by spaghetti sauce or barbecue sauce. The peroxyacid acids are particularly useful for removing dingy soils from textiles. As used herein, "dingy soils" are those which have built up on textiles after numerous cycles of usage and washing and thus, cause the white textile to have a gray or yellow tint. Accordingly, the bleaching mechanism herein preferably produces an effective amount of peroxyacid and DAP to bleach both dingy stains as well as stains resulting from spaghetti and the like.

Further, it is believed that bleach activators within the scope of the invention render the peroxygen bleaches more efficient even at bleach solution temperatures wherein the bleach activators are not necessary to activate the bleach, for example at temperatures above 60° C. As a consequence, less peroxygen bleach is required to obtain the same level of surface bleaching performance as compared with peroxygen bleach alone.

In a preferred embodiment, the bleach activator used in the granular detergent composition has the general formula

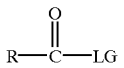

wherein R is an alkyl group, linear or branched, containing from about 1 to 11 carbon atoms and LG is a suitable leaving group. As used herein, a "leaving group" is any group that is displaced from the bleach activator as consequence of nucleophilic attack on the bleach activator by the perhydroxide anion, i.e. perhydrolysis reaction.

Generally, a suitable leaving group is electrophilic and is stable such that the rate of the reverse reaction is negligible. This facilitates the nucleophilic attack by the perhydroxide anion. The leaving group must also be sufficiently reactive for the reaction to occur within the optimum time frame, for example during the wash cycle. However, if the leaving group is too reactive, the bleach activator will be difficult to stabilize. In the past, it has been difficult to formulate granular detergent compositions having the desired stability for a practical shelf-life.

These characteristics are generally paralleled by the $pK_a$ of the conjugate acid of the leaving group, although exceptions to this convention are known. The conjugate acid of the leaving group in accordance with the present invention preferably has a $pK_a$ in a range from about 4 to about 13, more preferably from about 6 to about 11, and most preferably from about 8 to about 11.

Preferably, the leaving group has the formula

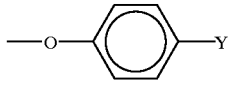

wherein Y is selected from the group consisting of $SO_3^-M^+$, $COO^-M^+$, $SO_4^-M^+$, $PO_4^-M^+$, $PO_3^-M^+$, $(N^+R^2_3)X^-$ and $O\leftarrow N(R^2_2)$, M is a cation and X is an anion, both of which provide solubility to the bleach activator, and $R^2$ is an alkyl chain containing from about 1 to about 4 carbon atoms or H. In accordance with the present invention, M is preferably an alkali metal, with sodium being most preferred. Preferably, X is a hydroxide, methylsulfate or acetate anion.

Other suitable leaving groups have the following formulas

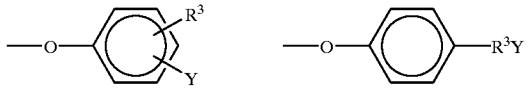

wherein Y is the same as described above and $R^3$ is an alkyl chain containing from about 1 to about 8 carbon atoms, H or $R^2$.

While numerous bleach activators as described above are suitable for use in the detergent composition, the preferred bleach activator has the general formula

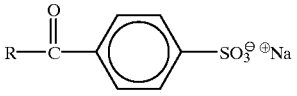

wherein R is an alkyl chain, linear or branched, containing from about 1 to about 11 carbon atoms. Most preferably, the bleach activator has the formula

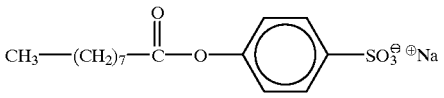

which is also referred to as sodium n-nonyloxybenzene sulfonate (hereinafter referred to as "NOBS"). This bleach activator and those described previously may be readily synthesized by well known reaction schemes or purchased commercially, neither of which is more preferred. Those skilled in the art will appreciate that other bleach activators beyond those described herein which are readily water-soluble can be used in the present granular detergent composition without departing from the scope of the invention.

Various additional nonlimiting examples of bleach activators which may be used herein are disclosed in Mao et al, U.S. Pat. No. 4,915,854, the disclosure of which is incorporated herein by reference.

Enzyme

Enzymes are included in the detergent composition disclosed herein for a wide variety of fabric laundering purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.005% to about 5%, more preferably, from about 0.16% to about 0.33%, by weight of a commercial enzyme preparation. Protease enzymes are usually present in such commercial preparations at levels sufficient to provide from 0.005 to 0.1 Anson units (AU) of activity per gram of composition. Accordingly, protease enzyme is most preferable for use in the present granular detergent composition.

Suitable examples of proteases are the subtilisins which are obtained from particular strains of B. subtilis and B. licheniforms. Another suitable protease is obtained from a strain of Bacillus, having maximum activity throughout the pH range of 8–12, developed and sold by Novo Industries A/S under the registered trade name ESPERASES®. The preparation of this enzyme and analogous enzymes is described in British Patent Specification No. 1,243,784 of Novo the disclosure of which is incorporated herein by reference. Proteolytic enzymes suitable for removing protein-based stains that are commercially available include those sold under the trade name ALCALASE™ and SAVINASE™ by Novo Industries A/S (Denmark) and MAXATASE™ by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985), all of which are incorporated herein by reference.

Amylases include, for example, α-amylases described in British Patent Specification No. 1,296,839 (Novo), RAPIDASE™, International Bio-Synthetics, Inc. and TERMAMYL™, Novo Industries.

The cellulases usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, incorporated herein by reference, which discloses fungal cellulase produced from Humicola insolens and Himicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832, all of which are incorporated herein by reference.

Suitable lipase enzymes for detergent usage include those produced by microorganisms of the Pseudomonas group, such as Pseudomonas stutzeri ATCC 19.154, as disclosed in British Patent 1,372,034, incorporated herein by reference. See also lipases in Japanese Patent Application 53-20487, laid open to public inspection on Feb. 24, 1978. This lipase is available from Amano Pharmaceutical Co. Ltd., Nagoya, Japan, under the trade name Lipase P "Amano," hereinafter referred to as "Amano-P". Other commercial lipases include Amano-CES, lipases ex *Chromobacter viscosum*, e.g. *Chromobacter viscosum* var. *lipolyticum* NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases ex *Pseudomonas gladioli*. The LIPOLASE™ enzyme derived from *Humicola lanuginosa* and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e., to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S, incorporated herein by reference.

A wide range of enzyme materials and means for their incorporation into synthetic detergent granules is also disclosed in U.S. Pat. No. 3,553,139, issued Jan. 5, 1971 to McCarty et al, incorporated herein by reference. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981 to Horn, et al, U.S. Pat. No. 3,600,319, issued Aug. 17, 1971 to Gedge, et al, and European Patent Application Publication No. 0 199 405, Application No. 86200586.5, published Oct. 29, 1986, Venegas, all of which are incorporated herein by reference. Enzyme stabilization systems are also described, for example, in U.S. Pat. 4,261,868, 3,600,319, and 3,519,570, all of which are incorporated herein by reference.

Optional Detergent Ingredients

The granular detergent composition of the invention can also include a wide variety of additional ingredients typically used in the art of detergency. For example, the detergent composition can include from about 1% to about 40% of a builder. Generally, the builder can be selected from the various water-soluble, alkali metal, ammonium or substituted ammonium phosphates, polyphosphates, phosphonates, polyphosphonates, carbonates, silicates, borates, polyhydroxy sulfonates, polyacetates, carboxylates, and polycarboxylates. Preferred are the alkali metal, especially sodium, salts of the above. Preferred for use herein are the phosphates, carbonates, silicates, $C_{10-18}$ fatty acids, polycarboxylates, and mixtures thereof. More preferred are sodium tripolyphosphate, tetrasodium pyrophosphate, citrate, tartrate mono- and di-succinates, sodium silicate, and mixtures thereof (see below).

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, 20 ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid. Some of these materials are useful as the water-soluble anionic polymer as hereinafter described, but only if in intimate admixture with the non-soap anionic surfactant.

Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Water-soluble silicate solids represented by the formula $SiO_2.M_2O$, M being an alkali metal, and having a $SiO_2:M_2O$ weight ratio of from about 0.5 to about 4.0, are useful salts in the detergent granules of the invention at levels of from about 2% to about 15% on an anhydrous weight basis, preferably from about 3% to about 8%. Anhydrous or hydrated particulate silicate can be utilized, as well.

The detergent composition can also include suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference. A polymeric dispersant such as polyaspartic acid, may also be included in the detergent composition disclosed herein.

Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and U.S. Pat. No. 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

The detergent composition of the invention optionally can contain various anionic, nonionic, zwitterionic, etc. surfactants. If used, such adjunct surfactants are typically present at levels of from about 5% to about 35% of the composition. However, it is to be understood that the incorporation of adjunct anionic surfactants is entirely optional herein, inasmuch as the cleaning performance of the secondary (2,3) alkyl sulfates is excellent and these materials can be used to replace entirely such surfactants as the alkyl benzene sulfonates in fully-formulated detergent compositions. Various nonlimiting examples of suitable adjunct surfactants can be found in Honsa, U.S. Pat. No. 5,174,927 (commonly assigned), the disclosure of which is incorporated herein by reference.

In order to make the present invention more readily understood, reference is made to the following examples, which are intended to be illustrative only and not intended to be limiting in scope.

EXAMPLE I

This Example demonstrates the unexpected superior cleaning performance achieved by the granular detergent composition described herein. As shown in Table I below, granular detergent compositions A and B are outside the scope of the invention while compositions C and D are made within the scope of the invention. More specifically, compositions A and B are completely devoid of a secondary (2,3) alkyl surfactant while compositions C and D include a secondary (2,3) alkyl surfactant as described previously.

TABLE I

| | Compositions (% weight) | | | |
|---|---|---|---|---|
| | A | B | C | D |
| Base Granule | | | | |
| $C_{12-16}$ secondary (2,3) alkyl sulfate | — | — | 2.6 | 3.4 |
| $C_{14-15}$ alkyl sulfate | 4.5 | 4.5 | 4.4 | 4.4 |
| $C_{14-15}$ alkyl ethoxylated sulfate (E03) | 2.2 | 2.2 | 2.1 | 2.1 |
| $C_{12-13}$ linear alkylbenzene sulfonate | 8.2 | 8.2 | 7.9 | 7.9 |
| Sodium sulfate | 12.9 | 12.9 | 12.6 | 12.5 |
| Aluminosilicate | 21.4 | 21.4 | 20.8 | 20.6 |
| Sodium citrate | 2.7 | 2.7 | 2.6 | 2.6 |
| Polyethylene glycol (MW4000) | 1.1 | 1.1 | 1.0 | 1.0 |
| Sodium carbonate | 8.0 | 8.0 | 8.9 | 8.8 |
| Sodium polyacrylate (MW4500) | 2.6 | 2.6 | 2.5 | 2.5 |

TABLE I-continued

| | Compositions (% weight) | | | |
|---|---|---|---|---|
| | A | B | C | D |
| Admix and Spray-on | | | | |
| Sodium nonanoyloxybenzene | 5.9 | 4.8 | 4.6 | 4.6 |
| Sodium perborate | 5.0 | 3.6 | 3.5 | 3.4 |
| Sodium carbonate | 15.6 | 15.6 | 15.2 | 15.1 |
| Protease enzyme | 0.2 | 0.2 | 0.2 | 0.2 |
| Misc. (water, perfume, etc.) | 9.7 | 12.2 | 11.1 | 19.9 |
| | 100.0 | 100.0 | 100.0 | 100.0 |

Compositions A, B, C and D are formulated for use at a level of about 1400 ppm, wash water weight basis, and at temperatures below about 50° C. The above compositions are made by combining the base granule ingredients as a slurry, and spray drying to a low level of residual moisture (5–6%). The remaining dry ingredients are admixed in granular powder form with the spray dried granule in a rotary mixing drum and the liquid ingredients (e.g. perfume) are sprayed onto the resulting granules.

For purposes of demonstrating the improved cleaning performance obtained with detergent compositions of the invention, compositions A, B, C and D in Table I are used to wash soiled items with water having a hardness level of about 12 grains/gallon in conventional full-scale laundry washing machines with 12 minute wash cycles, after which the items are dried for 50 minutes in conventional dryers. Panelists are asked to compare the clothes washed with detergent compositions B, C and D with the those clothes washed with detergent composition A which is outside the scope of the invention and assign grades according to the following scale:

0=no difference between two samples

1=think there is a difference

2=know there is a little difference

3=know there is a lot of difference

4=know there is a whole lot of difference

Each panelist grades the samples under standard lighting. Table II provides the results for compositions A, B, C and D. Composition A is normalized to a PSU score of "0" so as to provide a framework for comparing cleaning performance.

TABLE II

| | PSU | | | |
|---|---|---|---|---|
| Stain | A | B | C | D |
| Chocolate Pudding | 0.00 | −0.01 | 0.67 | 1.15 |
| Gravy | 0.00 | 0.51 | 0.57 | 1.41 |
| Spaghetti Sauce | 0.00 | −0.54 | 0.75 | 1.29 |
| Barbecue Sauce | 0.00 | −0.67 | 0.29 | 1.29 |
| beta-Carotene | 0.00 | −1.05 | −0.78 | 1.66 |
| Bacon Grease (cotton) | 0.00 | 0.09 | 0.93 | 1.03 |
| Bacon Grease (poly/cotton) | 0.00 | −0.10 | 1.23 | 0.94 |
| Clay | 0.00 | −0.16 | 1.15 | 1.47 |

From the results shown in Table II, it is apparent that granular detergent compositions C and D which include a secondary (2,3) alkyl surfactant and a bleaching system in accordance with the invention unexpectedly provide improved cleaning over compositions a and b which are outside the scope of the invention.

What is claimed is:

1. A granular detergent composition comprising, by weight:

(a) from about 1% to about 40% of a secondary (2,3) alkyl sulfate surfactant;

(b) from about 0.005% to about 5% of a protease enzyme (c) from about 0.5% to about 20% of a peroxygen bleaching agent; and (d) from about 0.5% to about 20% of a bleach activator having the formula

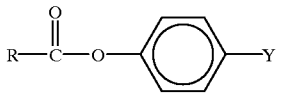

wherein R is an alkyl group containing from about 5 to about 18 carbon atoms;

wherein Y is selected from the group consisting of $SO_3^-M^+$, $COO^-M^+$, $SO_4^-M^+$, $PO_4^-M^+$, $PO_3^-M^+$, $(N^+R^2_3)X^-$ and $O{\leftarrow}N(R^2_2)$, M is a cation, X is an anion, and $R^2$ is an alkyl chain containing from about 1 to about 4 carbon atoms or H; and wherein said peroxygen bleaching agent and said bleach activator are in a molar ratio from about 1:1 to about 9:1.

2. The granular detergent composition of claim 1 wherein said bleach activator has the formula

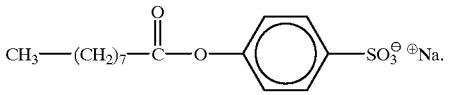

3. The granular detergent composition of claim 1 wherein said peroxygen bleaching agent is selected from the group consisting of percarbonates, perborates, peroxides and mixtures thereof.

4. The granular detergent composition of claim 1 wherein said molar ratio of said peroxygen bleaching compound to said bleach activator is from about 1.75:1 to about 4.5:1.

5. The granular detergent composition of claim 1 wherein said secondary (2,3) alkyl sulfate surfactant has an alkyl chain length in a range from about 10 to about 18.

6. The granular detergent composition of claim 1 further including from about 1% to about 40% of a builder.

7. The granular detergent of composition of claim 6 wherein said builder is selected from the group consisting of aluminosilicates, layered silicates, polycarboxylates, and mixtures thereof.

8. A method of laundering soiled clothes comprising the step of contacting said soiled clothes with an effective amount a granular detergent composition according to claim 1 in an aqueous media.

* * * * *